US008393035B2

(12) United States Patent
Pichon et al.

(10) Patent No.: US 8,393,035 B2
(45) Date of Patent: Mar. 12, 2013

(54) SUBMERGED SURFACE CLEANING APPARATUS WITH INLET DUCT OF NON-CONSTANT CROSS SECTION

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 188 days.

(21) Appl. No.: 12/808,790

(22) PCT Filed: Dec. 17, 2008

(86) PCT No.: PCT/FR2008/052346

§ 371 (c)(1),
(2), (4) Date: Sep. 20, 2010

(87) PCT Pub. No.: WO2009/081043

PCT Pub. Date: Jul. 2, 2009

(65) Prior Publication Data

US 2011/0000035 A1 Jan. 6, 2011

(30) Foreign Application Priority Data

Dec. 21, 2007 (FR) ..... 07 09001

(51) Int. Cl.
*E04H 4/16* (2006.01)

(52) U.S. Cl. ..... 15/1.7; 210/167.16; 210/232

(58) Field of Classification Search ..... 15/1.7; 210/167.1, 167.16, 167.17, 416.2, 459; 4/490, 4/496; 134/110, 109, 167 R, 168 R; *E04H 4/16*
See application file for complete search history.

(56) References Cited

U.S. PATENT DOCUMENTS 3,892,282 A * 7/1975 Wulc ..... 180/6.5
4,768,532 A * 9/1988 Johnson ..... 134/111
5,842,243 A * 12/1998 Horvath et al. ..... 15/1.7

(Continued)

FOREIGN PATENT DOCUMENTS

EP 0483470 5/1992
FR 2685371 6/1993

(Continued)

OTHER PUBLICATIONS

International Search Report in Application No. PCT/FR2008/052346.

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface including a body and members for driving the body over the immersed surface in a main direction of advance; a filtration chamber which is provided in the body and which has: a liquid inlet conduit which extends inside the body and which has a lower end which forms a liquid inlet and an opposing upper end which opens into a filtering device; a liquid outlet out of the body; a hydraulic circuit for the flow of liquid between the inlet and the liquid outlet through the filtering device, wherein the inlet conduit has a regular cross-section whose surface-area varies from the lower end thereof up to a maximum value at the upper end thereof which opens in the filtering device.

10 Claims, 7 Drawing Sheets

U.S. PATENT DOCUMENTS

Figure 1:
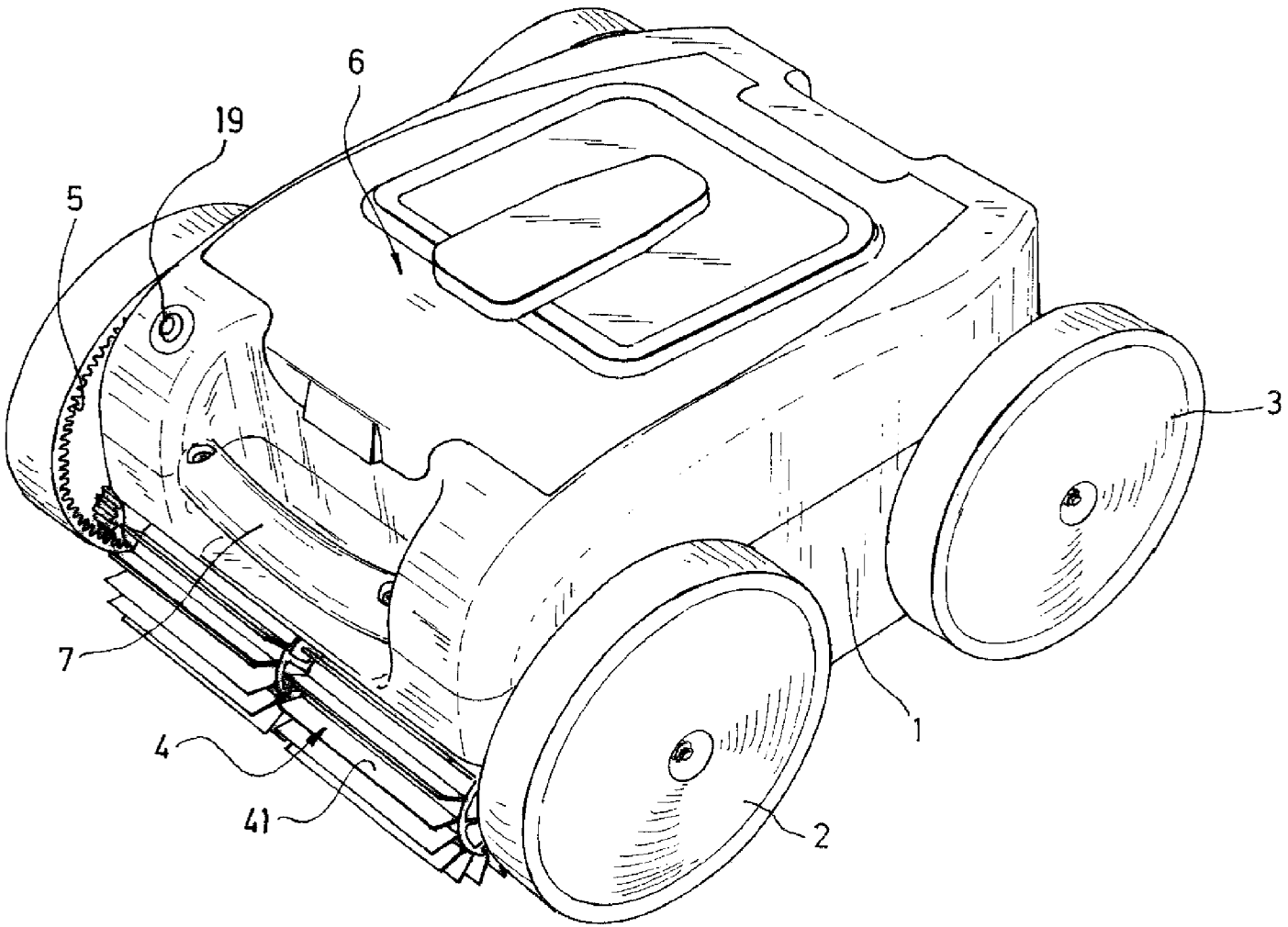

| | | | | |
|---|---|---|---|---|
| 6,013,178 | A | 1/2000 | Strano et al. | |
| 6,409,916 | B1 * | 6/2002 | Zelas et al. | 210/167.16 |
| 6,473,927 | B1 * | 11/2002 | Sommer | 15/1.7 |
| 6,627,074 | B2 * | 9/2003 | Lincke | 210/167.17 |
| 6,886,205 | B1 * | 5/2005 | Pichon | 15/1.7 |
| 2002/0104790 | A1 | 8/2002 | Lincke | |
| 2004/0168838 | A1 | 9/2004 | Erlich et al. | |
| 2007/0251032 | A1 * | 11/2007 | Pichon et al. | 15/1.7 |

FOREIGN PATENT DOCUMENTS

| | | |
|---|---|---|
| FR | 2896004 | 7/2007 |

* cited by examiner

SUBMERGED SURFACE CLEANING APPARATUS WITH INLET DUCT OF NON-CONSTANT CROSS SECTION

CROSS REFERENCE TO RELATED APPLICATIONS

This application is the U.S. national phase of International Application No. PCT/FR2008/052346 filed on Dec. 17, 2008 and published on Jul. 2, 2009 as International Publication No. WO 2009/081043 A2, which application claims priority to French Patent Application No. 0709001 filed on Dec. 21, 2007, the entire contents of both of which are incorporated herein by reference.

The invention relates to a device for cleaning a surface which is immersed in a liquid, in particular a swimming pool surface.

A number of known swimming pool cleaning devices comprise:

- a hollow body and members for guiding and driving the hollow body over the immersed surface in a preferred direction of advance and in a main direction of advance, called the longitudinal direction,
- a filtration chamber which is provided in the hollow body and which has:
- at least one liquid inlet into the hollow body located at the base and at the front of the hollow body,
- at least one liquid outlet out of the hollow body, located remotely from the base of the hollow body,
- a hydraulic circuit which is capable of providing a flow of liquid between each inlet and each outlet through a filtering device under the action of a pumping device.

In some of these known devices (cf., for example, US 2004/0168838, U.S. Pat. No. 6,013,178), the filtering device is arranged immediately downstream of the liquid inlet. This arrangement is considered to promote the efficiency of the pumping device by minimizing the hydraulic path between the liquid inlet and the filtering device, which limits in particular the pressure losses and optimizes the flow of liquid.

The inventors have established that this arrangement is extremely unfavorable with respect to the performance levels of the device, in particular with regard to the filtration performance levels. Such an arrangement would appear to promote the clogging of the walls of the filtering device with the debris which are drawn in by the device. Consequently, such devices do not have levels of filtration performance which are stable over time, in particular during the cleaning of an immersed surface which is heavily clogged with debris. The service periods of the device between which a cleaning operation must be carried out are relatively short if the surface is very clogged with debris and in particular very variable depending on the type of waste recovered with the result that they vary randomly for the user. For example, if the pool is clean but the device draws in a single large leaf, this leaf is capable of substantially blocking the filtering device, making it necessary to clean the filtering device. In this manner, the filtration and suction performance levels of these known devices may decrease rapidly in a random manner from the viewpoint of the user and when the quantity of debris recovered is very much lower than the quantity corresponding to the capacity of the filtering device.

There are other devices (FR 2 685 371, EP 0 483 470) which comprise at least one liquid inlet conduit which extends inside the hollow body and which has an end at the base of the hollow body, called the lower end, which forms a liquid inlet in the hollow body, and an opposing end which opens into a filtering device.

The disadvantage of these devices is in particular that they involve the use of a powerful pumping motor in order to allow the liquid to reach the filtering device. Furthermore, EP 0 483 470 uses, as a filtering device, a filtering grid which inevitably results in the filtering walls becoming clogged.

In this regard, an object of the invention is to provide a device for cleaning an immersed surface which has improved levels of filtration performance compared with devices of the prior art.

An object of the invention is also to provide, for cleaning an immersed surface, a device whose performance/cost ratio is greatly improved relative to that of prior devices. More specifically, an object of the invention is to provide such a device whose cost can be substantially reduced, with performance levels which are equivalent to those of known devices.

An object of the invention is also to provide, for cleaning an immersed surface, a device whose levels of filtration performance are stable over time, regardless of the nature of the debris, including when cleaning an immersed surface which is heavily clogged with debris, in particular voluminous debris which are larger than a 2 Euro coin.

The invention relates to any swimming pool cleaning device of the type mentioned above, which may be driven particularly in an electrical, hydraulic or mixed manner. However, an object of the invention is more specifically to provide such a device of the type which is self-propelled and which has (an) electric drive motor(s).

To this end, the invention relates to a device for cleaning an immersed surface comprising:

- a hollow body and members for guiding and driving the hollow body over the immersed surface in a main direction of advance, called the longitudinal direction,
- in the hollow body, a filtration chamber comprising:
- at least one liquid inlet conduit extending inside the hollow body, and having a first end, called the lower end, at the base of said hollow body, said lower end forming a liquid inlet in the hollow body, and a second opposing end, called the upper end, opening into a filtering device,
- at least one liquid outlet out of the hollow body, located remotely from the base of the hollow body,
- a hydraulic circuit which is capable of providing a flow of liquid between each liquid inlet and each liquid outlet through the filtering device under the action of a pumping device, wherein at least one liquid inlet conduit has a regular cross-section whose surface-area varies from the lower end thereof, which forms a liquid inlet, up to a maximum value at the opposing upper end thereof which opens in the filtering device.

The inventors have determined that the provision of a liquid inlet conduit whose regular cross-section is non-constant between the lower end thereof and the upper end thereof not only allows the device to be provided with a pumping device having power which is equal to or even less than previous devices, but also allows the filtration performance levels to be greatly improved. To this end, the conduit must have a regular cross-section whose surface-area in the region of the upper end of the conduit, that is to say, the end which opens into the filtering device, is at a maximum. The regular cross-section of the conduit determines an effective cross-section for passage of liquid. In particular, such a configuration allows the speed to be reduced for debris which are drawn into the inlet conduit when they reach this portion of the conduit which has a maximum cross-section surface-area. This portion is the antechamber of the filtering device. Consequently, the debris enter the filtering device at a low speed. This low speed allows debris to be prevented from adhering to the filtering walls of the filtering device. The variation of the regular cross-section along the conduit must be determined with care so that the debris acquire sufficient speed to reach the filtering device but this speed is sufficiently low in the antechamber of the filtering device to prevent the walls from becoming clogged.

Advantageously and according to the invention, at least one inlet conduit, in particular each inlet conduit, has a first portion which converges from the lower end thereof as far as a zone which forms a neck having a minimum surface-area, and a second divergent portion which extends the first portion from the neck as far as the opposite upper end thereof which opens in the filtering device, in order to form a convergent/divergent inlet conduit.

Such a convergent/divergent inlet conduit confers on a device according to the invention particularly advantageous specific properties. In particular, the first convergent portion allows the debris to be accelerated when entering the inlet conduit between the lower end and the neck which has a minimum surface-area. This acceleration is intended to provide sufficient speed for the debris, in particular heavy debris, to be able to reach the upper end of the inlet conduit. The second portion allows the debris to be slowed, in particular small debris, which are in close contact with the liquid, between the neck having a minimum surface-area and the upper end having a maximum surface-area so that, when they reach the filtering device, they have a low speed so that they are not thrown against the filtering walls of the filtering device, thereby preventing the walls from becoming clogged.

The dimensions of the first and second portions may be selected in a different manner. However, after various experiments, the inventors have established that a particularly advantageous solution involves advantageously making provision for at least one inlet conduit—in particular each inlet conduit—to have a first portion which extends over less than 20% of the total length of the inlet conduit and a second portion which extends over more than 80% of the total length of the conduit. Advantageously and according to the invention, at least one inlet conduit has, in the region of the upper end thereof, a regular cross-section having a surface-area which is twice as large as the surface-area of the regular cross-section in the region of the lower end thereof. Advantageously and according to the invention, the surface-area of the cross-section in the region of the neck is approximately 20% smaller than the surface-area of the cross-section in the region of the lower end. Furthermore, it is particularly advantageous for the inlet conduit to have in the region of the upper end of the conduit, for example, over an extreme portion in the order of 10% of the length of the conduit, a significant widening. Such a widening may, for example, correspond to an increase in the order of 33% of the surface-area of the cross-section over this extreme portion.

According to this variant, the debris acquire in the first portion significant kinetic energy which they retain over a good portion of the inlet conduit. The speed of the debris decreases suddenly in the significantly widened part of the portion, which corresponds to 10% of the inlet conduit. Consequently, these debris may reach the upper end of the inlet conduit and enter the filtering device but without the risk of adhering to the filtering walls of the filtering device.

Advantageously and according to the invention, at least one inlet conduit—in particular each inlet conduit—has a profile, called the longitudinal profile—in section through a longitudinal plane, which is generally divergent from the lower end thereof which forms a liquid inlet as far as the opposing upper end thereof which opens in the filtering device.

Advantageously and according to the invention at least one inlet conduit—in particular each inlet conduit—has a profile, called the transverse profile in section along a transverse plane, which is orthogonal relative to the longitudinal direction and which has a convergent/divergent shape.

Advantageously and according to the invention, the surface-area of the regular cross-section of at least one inlet conduit—in particular each inlet conduit—varies at least substantially continuously from the lower end thereof which forms a liquid inlet in this inlet conduit as far as the opposing upper end thereof which opens in the filtering device.

Advantageously and according to the invention, at least one inlet conduit—in particular each inlet conduit—is curved.

Advantageously and according to the invention, at least one inlet conduit—in particular each inlet conduit—is generally orthogonal relative to the immersed surface.

A device according to the invention may comprise one or more inlet conduits. Advantageously, however, a device according to the invention comprises a single liquid inlet conduit in the hollow body.

A filtering device of a device according to the invention may have various shapes and sizes. Such a device may, for example, be formed by a casing which is capable of being inserted into the filtration chamber and removed therefrom in one piece. Such a casing may be formed by one or more components which are fitted together using any type of means. In particular, such a casing may be formed by one or more rigid, semi-rigid or flexible shells.

Advantageously and according to the invention, the filtering device comprises:

- a first shell which has peripheral filtering walls which extend towards the rear of the hollow body from a front opening of this first shell and which delimit, towards the rear, a space for recovering debris, the filtering walls being capable of retaining any debris conveyed by the liquid and allowing the flow of liquid from this first shell,
- a second shell which is fitted to the first shell at the front thereof and which forms a liquid inlet conduit having a non-constant regular cross-section.

Advantageously and according to the invention, the two shells and their relative assembly are adapted in such a manner that:

- the two shells can be fitted together so as to form an integral filtering casing which is removably mounted in the filtration chamber whilst the device rests in the cleaning position on a horizontal surface, this filtering casing being able to be inserted into the filtration chamber in one piece and removed in one piece from this filtration chamber,
- when the two shells are fitted together, the second shell closes the front opening of the first shell, with the exception of a liquid inlet passage which constitutes a liquid inlet opening into the debris recovery space, the cross-section of this inlet opening being smaller than that of the front opening of the first shell,
- the two assembled shells can be moved relative to each other, after removing the filtering casing from the filtration chamber, by disengaging the front opening of the first shell which acts as an opening for emptying this first shell.

A device according to the invention, which comprises a filtering device of this type with two shells which are fitted together in such a manner that, when assembled, they form an integral filtering casing which can be readily removed from the device, is particularly practical to use. Such a filtering casing has a first shell which acts as a pocket for recovering debris and a second shell which forms an inlet conduit having a non-constant regular cross-section as described above and partially blocks the debris recovery pocket so that, when the device is being operated over an immersed surface, the debris are received in the debris recovery pocket and are unable to be discharged via the liquid inlet. Furthermore, the two shells are capable of being able to be disengaged from each other after the filtering casing has been removed from the device. Consequently, it is particularly convenient to clean the filtering device by separating the two shells from each other and removing the debris which are lodged in the debris recovery pocket. After the first shell has been cleaned, a user can fit the shells together and reinsert the filtering casing thus formed in the device.

Furthermore, such an arrangement is particularly effective since the filtering casing formed in this manner comprises a lower end which opens at the base of the hollow body and which constitutes a liquid inlet. In this manner, this filtering casing forms the "unclean" portion, called the unclean circuit, of the hydraulic circuit of the device, that is to say, the portion of the hydraulic circuit which is capable of conveying debris. Since the filtering casing is removable, the unclean circuit can be integrally removed. A user is therefore able to clean all of the unclean circuit of the device and thus restore the initial performance levels to a device according to the invention.

Advantageously and according to the invention, the second shell which forms at least one inlet conduit has a rear transverse separation wall which extends transversely at the front of the debris recovery space, between each liquid inlet and the inlet opening provided at an upper end of this inlet conduit.

This transverse rear wall acts as a non-return wall in such a manner that the debris which have passed through this wall can no longer be discharged via the liquid inlet, including when the pumping device is idle, which eliminates the need to provide valves or other movable non-return devices at the liquid inlets.

The inventors have further found that the provision of this wall in the path of the liquid between each liquid inlet and each liquid outlet which at first may seem unfavorable with respect to the levels of hydraulic performance (flow, suction, . . . ) in practice allows the filtration performance levels of the device to be improved owing to the generation of a turbulent flow within the filtering device which permanently retains the debris in suspension in the filtering device, thereby preventing the walls of the filtering device from becoming clogged, and finally promoting the hydrodynamic performance levels of the filtering device and the hydraulic circuit.

That is to say, the pressure losses brought about by the arrangement of a wall in the hydraulic path are compensated for by retaining the initial permeability of the filtering walls of the filtering device. Furthermore, the service periods between which the device must be cleaned are longer and in particular are of a substantially constant length of time, which leads to greater user comfort.

Advantageously and according to the invention, the first shell comprises a rigid frame which is capable of imposing a three-dimensional shape on these peripheral walls, and a filtering sheet which extends into openings which are provided by the rigid frame.

Advantageously and according to the invention, the first shell has a regular cross-section which decreases from the front towards the rear.

A filtering device whose regular cross-section decreases from the front to the rear allows substantially tangential filtration of the liquid flowing in the filtering device. Such a principally tangential filtration also serves to limit clogging of the filtering walls with obstructive debris (such as dead leaves), which ensures good suction and good filtering, including after a long period of operation. Furthermore, it would appear that such a convergent shell also brings about a swirling flow of the liquid flowing in this pocket, which ensures continuous declogging of the walls of the pocket which has the effect of restoring the initial permeability to the various walls of the pocket.

Advantageously and according to the invention, the first shell has a horizontal upper wall which extends from the front opening and a lower rear wall which is inclined backwards and upwards from a base portion of the shell as far as an upper extreme rear portion.

Advantageously and according to the invention, at least one of the shells has a handle for handling the filtering casing.

Such a handle allows the filtering casing to be readily handled when the two shells are fitted together.

Advantageously and according to the invention, the access flap is provided on an upper wall of the hollow body.

Such a device is particularly practical to handle since removing the filtering device from the device does not involve complex operations of the device. In particular, it is not necessary to invert the device in order to remove the filtering device in order to clean it. Disassembling the filtering device can be carried out when the device is in the rest position, in its normal position, on a horizontal surface.

Advantageously, a device according to the invention does not have any liquid non-return valve.

Advantageously, a device according to the invention comprises at least one liquid outlet out of the hollow body which is called the rear outlet and which is offset towards the rear relative to the filtering casing.

Advantageously, a device according to the invention comprises a rear outlet which generates a flow of liquid which is orientated with a longitudinal component towards the rear.

These provisions allow the device to be configured so as to recover directly at least part of the residual hydraulic energy in the discharge flow in order to contribute to driving the device.

Consequently, with equivalent suction and cleaning performance levels, a device according to the invention may be provided with a pumping motor—in particular an electric pumping motor—and a driving device—comprising in particular at least one electric drive motor—whose power is reduced and which therefore involves lower consumption and costs. Consequently, the device is also generally smaller and lighter which, in addition to the savings made, is a significant advantage for the user, in particular in terms of handling, transport and storage of the device.

The invention further relates to a device for cleaning an immersed surface, characterized in combination by all or some of the features mentioned above or below.

Figure 2:
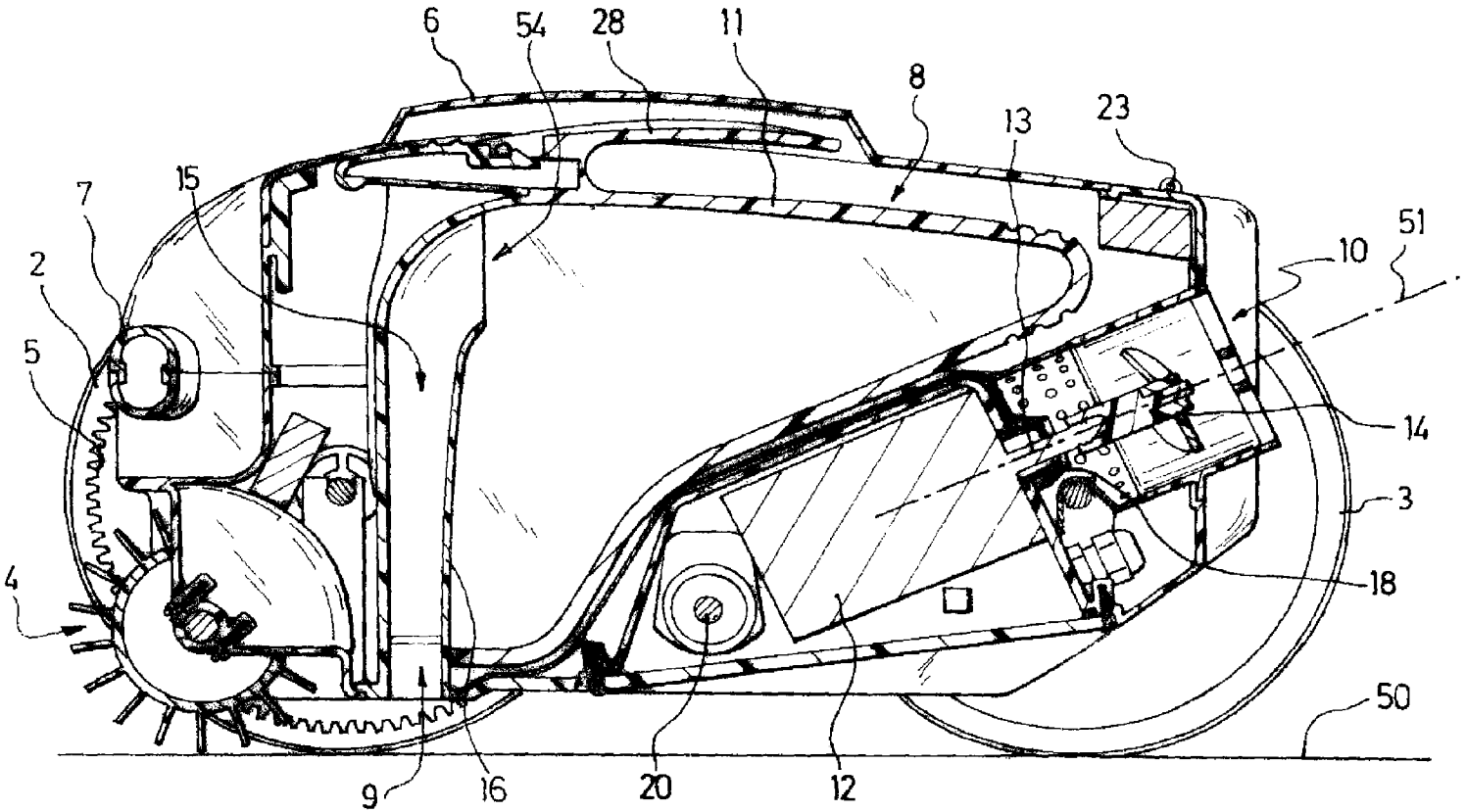
Figure 3:
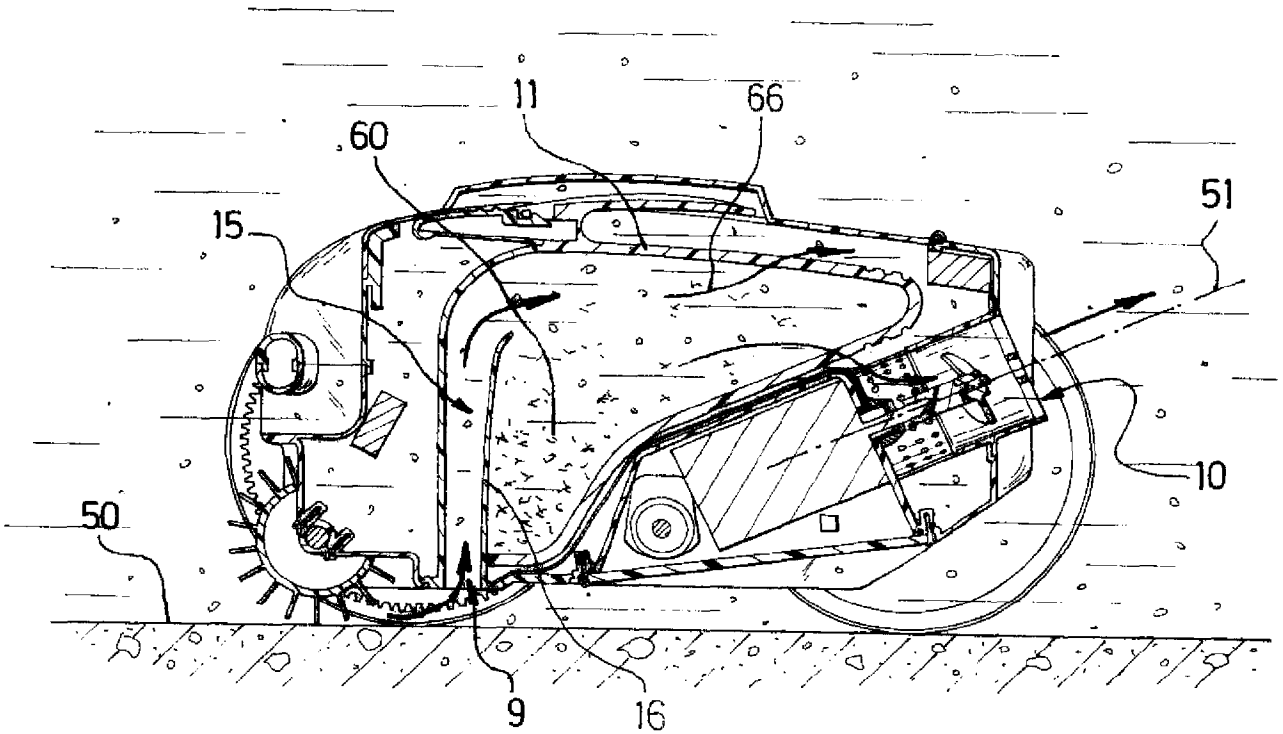
Figure 4:
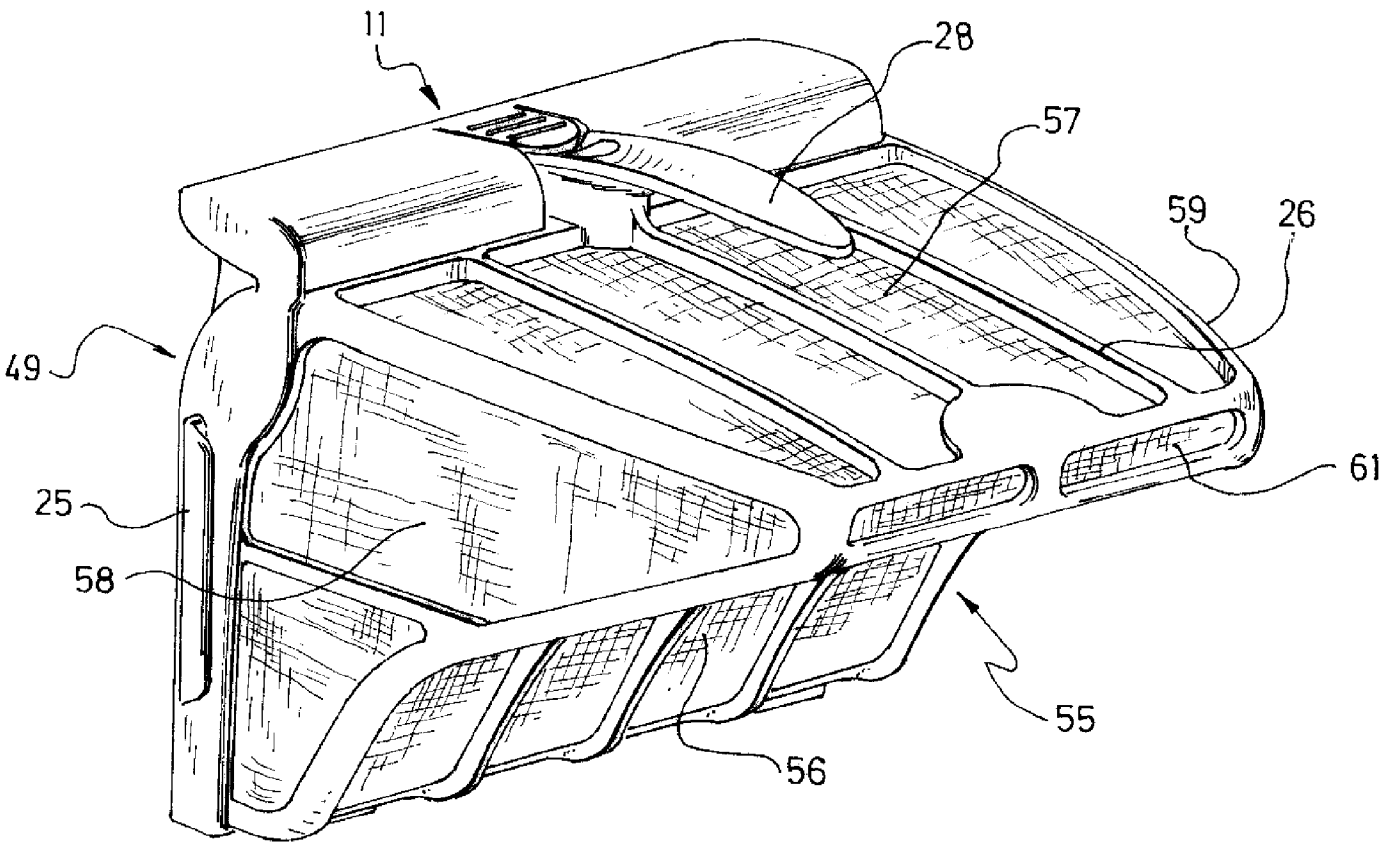
Figure 5:
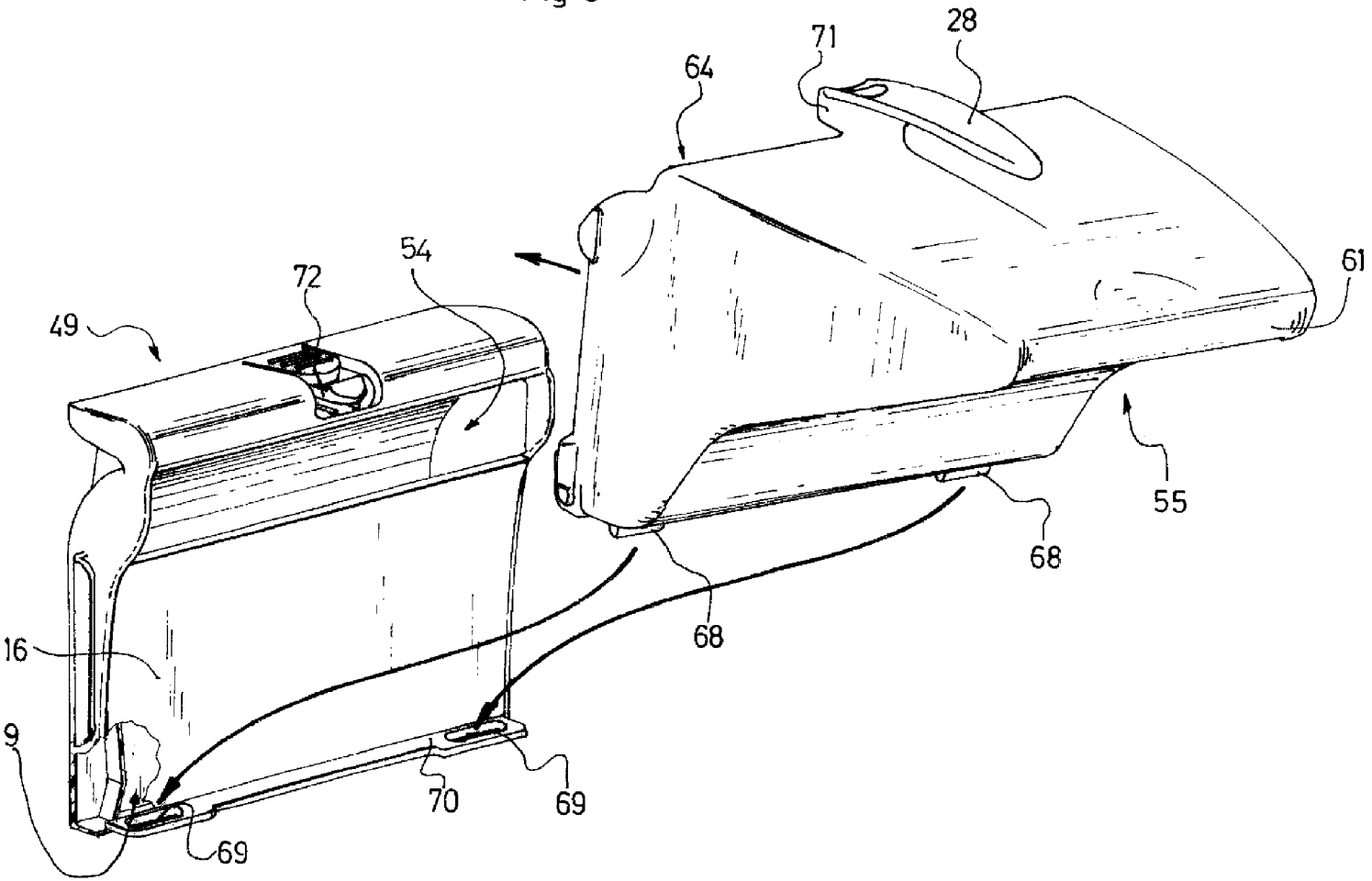
Figure 6:
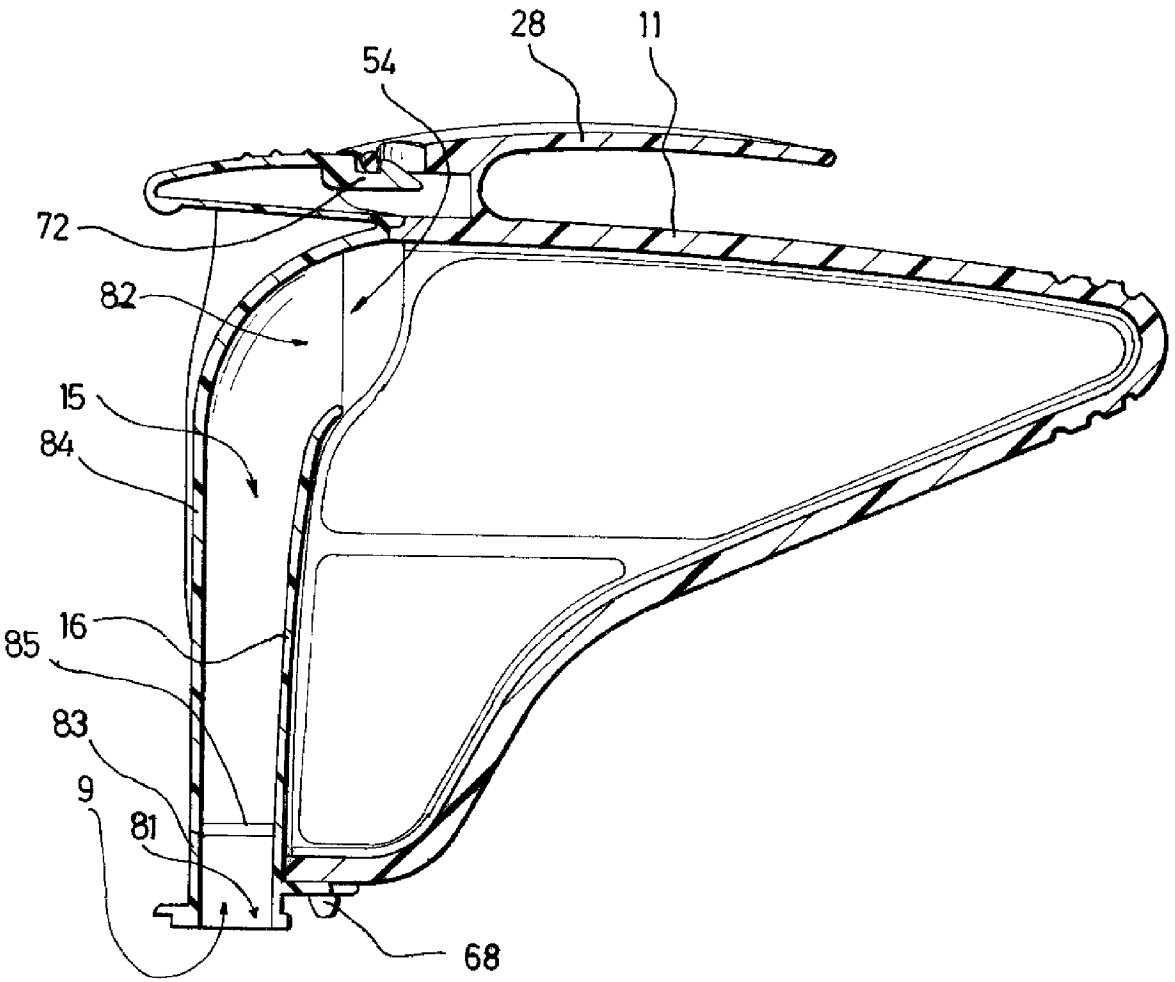
Figure 7:
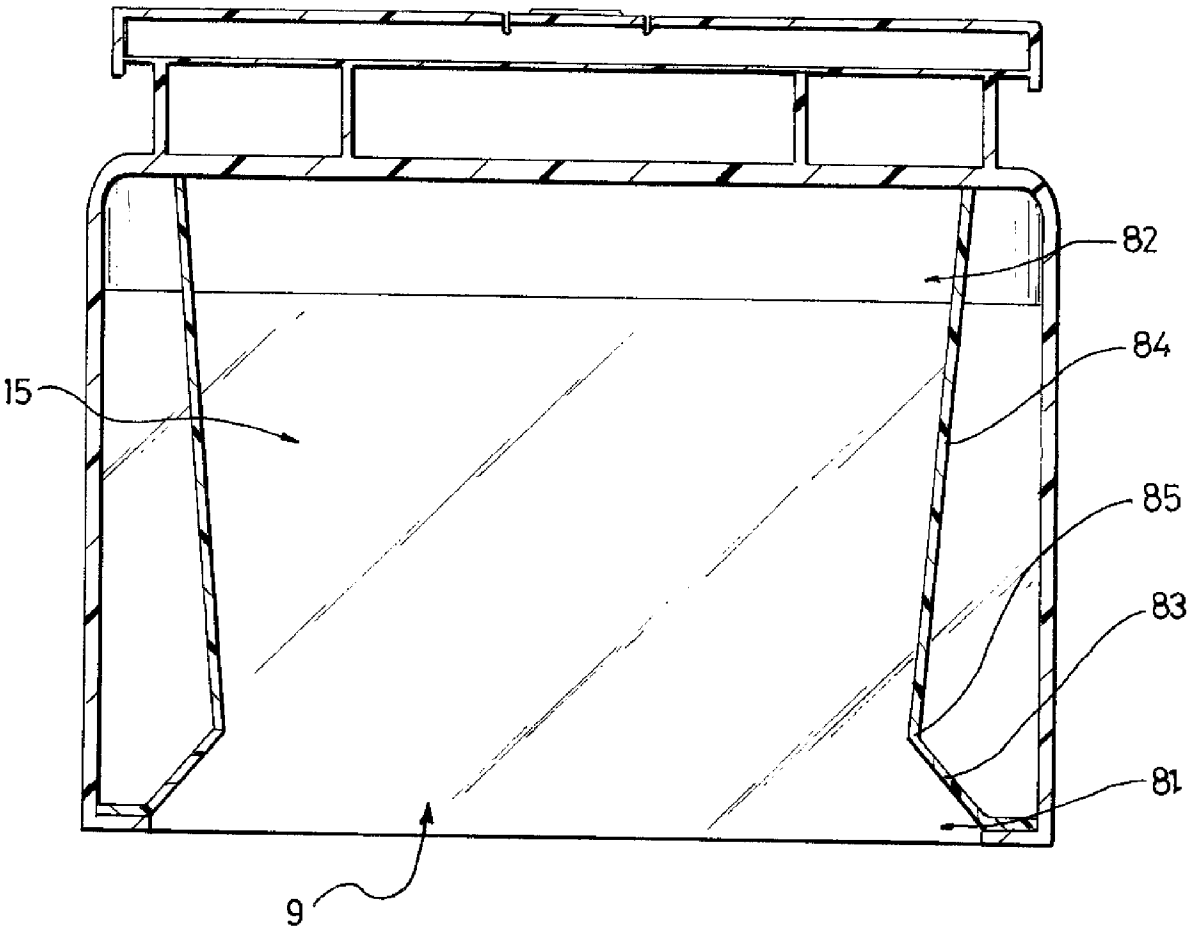

Other features, objectives and advantages of the invention will be appreciated from a reading of the following description which sets out, by way of non-limiting example, an embodiment of the invention with reference to the appended drawings, in which:

FIG. 1 is a schematic perspective view of a cleaning device according to an embodiment of the invention, FIG. 2 is a schematic longitudinal section of a cleaning device according to an embodiment of the invention, FIG. 3 is a simplified longitudinal section of FIG. 2 illustrating the device during operation over an immersed surface, FIG. 4 is a schematic perspective view of a filtering device of a device according to an embodiment of the invention comprising two shells which are fitted together, FIG. 5 is a schematic perspective view of the filtering device of FIG. 4 illustrating the two shells separated from each other, FIG. 6 is a schematic longitudinal section of the filtering device of FIG. 4, the two shells being fitted together, FIG. 7 is a schematic cross-section of the device of FIG. 4 in the region of the inlet conduit of this device.

In the Figures, the scales and proportions are not strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear are defined.

A device according to the invention comprises a hollow body 1 and rolling members 2, 3, 4 for guiding and driving the hollow body 1 over an immersed surface in a main direction of advance, called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber which is capable of receiving a filtration chamber. This central chamber is delimited by a lower wall which extends in a substantially horizontal plane; by lateral walls which generally extend in vertical planes; by a front wall which generally extends in a vertical plane, orthogonal relative to the planes of the vertical lateral walls; and by a rear wall which generally extends in a vertical plane orthogonal relative to the planes of the vertical lateral walls.

The lower wall has an opening which extends transversely in the region of the front wall so that liquid is able to enter the central chamber via this lower transverse opening. This opening forms a liquid inlet 9 in the hollow body 1.

The rear wall comprises a cylindrical opening which forms a liquid outlet 10 out of the hollow body 1. This liquid outlet 10 which is provided in the rear wall of the housing is longitudinally offset from the liquid inlet 9 which is provided in the lower wall. Furthermore, this liquid outlet 10 is provided in the upper portion of the housing in such a manner that it is also vertically offset from the liquid inlet 9.

As illustrated in particular in FIG. 2, this central chamber, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

Preferably, the liquid inlet 9 and liquid outlet 10 are centered on the same longitudinal vertical center plane of the device.

The central chamber of the hollow body 1 is capable of receiving a filtering device 11. The filtering device 11 comprises, as illustrated in particular in FIGS. 4 and 5, two shells, a first shell 55 which forms a pocket for recovering debris and a second shell 49 which is capable of being fitted to the first shell 55.

The first shell 55 which forms a debris recovery pocket of the filtering device 11 has peripheral filtering walls 56, 57, 58, 59 which extend towards the rear from a front opening 64. These filtering walls 56, 57, 58, 59 are capable of retaining any debris conveyed by the liquid and allowing liquid to flow out of this first shell 55.

The second shell 49 forms a liquid inlet conduit 15 in the hollow body 1. This liquid inlet conduit 15 extends inside the hollow body 1 and has an end at the base of the hollow body 1, called the lower end 81, and an opposing end, called the upper end 82, which opens, when the shells 49 and 55 are fitted together, in the first shell 55. This inlet conduit 15 has a regular cross-section whose surface-area varies from the lower end 81 thereof up to a maximum value at the upper end 82 thereof.

To this end, and as illustrated in FIGS. 6 and 7, the inlet conduit 15 has a longitudinal profile which is generally divergent from the lower end 81 thereof as far as the upper end 82 thereof, and a transverse profile which has a convergent/divergent shape. The inlet conduit 15 has a first portion 83 which converges from the lower end 81 thereof as far as a zone which forms a neck 85 having a minimum surface-area, and a second divergent portion 84 which extends the first portion 83 from this neck 85 as far as the upper end 82 thereof. According to a preferred embodiment of the invention, the first portion 83 extends over less than 20% of the total length of the inlet conduit and the second portion 84 extends over more than 80% of the total length of the conduit 15. Furthermore, the inlet conduit 15 has, in the region of the upper end 82 thereof, a regular cross-section which has a surface-area which is twice as large as the surface-area of the regular cross-section in the region of the lower end 81 thereof. The surface-area of the cross-section in the region of the neck 85 is approximately 20% less than the surface-area of the cross-section in the region of the lower end 81.

The assembly between the first shell 55 and the second shell 49 can be produced using various means. For example, and as illustrated in FIG. 5, the first shell 55 comprises, in the region of the front lower end thereof, pins 68 which protrude from the plane of the opening 64 of the first shell 55. These pins 68 have shapes and dimensions which correspond to and complement the apertures 69 which are provided in tongues 70 which are fixedly joined to the rear lower end of the inlet conduit 15 and which are substantially perpendicular relative to the rear wall 16 of the conduit so that these pins 68 can engage in the apertures 69 and allow a mechanical connection of the lower ends of the first shell 55 and the second shell 49. Furthermore, the first shell 55 has, in the region of the front upper end thereof, an element 71 which is capable of engaging in a catch 72 which is provided in the region of the upper end of the front wall of the conduit 15 in order to allow the assembly between the upper ends of the first shell 55 and the second shell 49. This element 71 protrudes relative to the plane of the opening 64 and has a strip which extends downwards and which is not illustrated in the Figures and which is capable of engaging in the catch 72. The end of the catch 72 orientated towards the first shell 55 is further beveled in order to facilitate the insertion of the strip of the element 71 in the catch 72. Furthermore, this strip 72 is flexible in terms of compression so that it can become slightly deformed in a downward direction during the engagement between the element 71 and this catch 72. This flexibility in terms of compression also allows a user to apply a downward pressure to the catch 72, for example, using his thumb, which allows the strip of the element 71 to be disengaged from the catch 72, thus bringing about a separation of the upper ends of the first shell 55 and the conduit 15. The assembly between the first shell 55 and the second shell 49 is produced by first fitting the lower ends to each other, then by fitting the upper ends one inside the other. The shells are separated by first disengaging the upper ends from each other, then by disengaging the lower ends from each other. The assembly and the separation of the first shell 55 and the second shell 49 can therefore be readily carried out by a user without any tools.

This relative assembly between the first shell 55 and the second shell 49 is adapted so that, once assembled, the second shell 49 closes the front opening 64 of the first shell 55, with the exception of a liquid inlet passage which constitutes a liquid inlet opening 54 in the first shell 55, the cross-section of this inlet opening 54 being smaller than that of the front opening 64 of the first shell 55.

The first shell 55 which forms the pocket for recovering debris is formed by a rigid frame 26 and a filtering sheet—in particular a filtering material—which extends into openings which are provided by this frame. The filtering device 11 is therefore self-supporting and can be readily handled by a user. Furthermore, this filtering device 11 forms a removable filtering casing whose lower end defined by the lower end of the inlet conduit 15 forms the liquid inlet 9 in the hollow body 1.

Furthermore, the first shell 55 has a regular cross-section which decreases from the front opening 64 towards the liquid outlet 10 in order to form a convergent chamber for tangential filtering of the liquid flowing between the opening 64 and the liquid outlet 10.

According to the embodiment of the Figures, the first shell 55 has a lower filtering wall 56 which is inclined backwards and upwards from a base portion of the first shell 55. This inclined lower wall 56 forms with the longitudinal direction an angle which, in the example illustrated, is in the order of 45°.

This first shell 55 further comprises a generally horizontal upper wall 57 which extends towards the rear from the front opening 64. This upper filtering wall 57 is connected to the lower filtering wall 56 by an upper rear extreme curved portion 61. The rear extreme curved portion 61 has a minimal regular cross-section whilst the portion of the first shell 55 opposite this curved portion 61, that is to say, in the region of the front opening 64, has a maximum regular cross-section. In this manner, the first shell 55 has a regular cross-section which decreases from the front opening 64 towards the rear extreme curved portion 61, that is to say, towards the rear outlet 10. That is to say, the first shell 55 has a regular cross-section which is in the form of a rectangular triangle, the inclined lower wall 56 forming the hypotenuse.

The device also comprises, as illustrated in FIG. 1, a flap 6 for access to this filtering device 11. This access flap 6 forms an upper wall of the hollow body 1 and covers it. In the embodiment illustrated, this flap 6 is arranged on the upper portion of the device so that a person using the device can readily open the flap 6 and remove the filtering device 11. Preferably, the access flap 6 is articulated to the body 1 of the device by means of hinges 23 which are provided at the rear of the device.

Preferably, the filtering device 11 is a device which is mounted in the filtration chamber 8 of the hollow body 1 in the manner of a drawer. To this end, the rigid frame 26 of the filtering device 11 further has two ribs 25 which extend laterally at each side of the filtering device 11. These ribs are preferably provided on the lateral walls of the inlet conduit 15 since this conduit has no filtering walls. However, according to other embodiments, they could be provided on the lateral walls of the filtering walls, for example, on the frame 26 of the first shell. Regardless of their position, these ribs 25 have shapes and dimensions which correspond to and complement the shapes and dimensions of grooves 24 which are fixedly joined to the hollow body 1. These grooves 24 which are fixedly joined to the hollow body 1 extend vertically along the inner faces of the vertical lateral walls of the hollow body 1. The ribs 25 of the filtering device 11 are therefore capable of co-operating with the grooves 24 of the hollow body 1 of the device.

In this manner, the removal of the filtering device 11 is the result of a translation movement of the filtering device 11 along the grooves 24 of the hollow body 1. A user can therefore readily remove the filtering device 11 from the hollow body 1, for example, in order to clean it. After the filtering device 11 has been removed, a user, as indicated above, can readily separate the two shells which form this device. This user can therefore clean the first shell which forms the debris recovery pocket and the second shell 49 which forms the inlet conduit 15 and the liquid inlet 9 which is arranged at the lower end of the inlet conduit 15. After the first shell 55 and the second shell 49 have been cleaned, the user can readily assemble the shells 49, 55 as indicated above and easily reintroduce the filtering device 11 in one piece into the hollow body 1 by orientating the filtering device 11 so that the ribs 25 of the filtering device 11 are opposite the grooves 24 of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is out of the liquid and resting on a horizontal surface. According to a particularly advantageous embodiment, the handle 28 is the continuation of the rear portion of the element 71.

According to the invention, a device comprises a motorized liquid pumping device which comprises an electric pumping motor 12 which has a rotating drive shaft 13 which is coupled to a pumping propeller 14 which is interposed in the hydraulic circuit in order to generate therein a liquid flow between the liquid inlet 9 and the liquid outlet 10.

The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis 51 of the propeller 14.

The pumping propeller 14 has an orientation which allows a flow of liquid to be generated with a horizontal component towards the rear.

Preferably, the pumping propeller 14 which is interposed in the hydraulic circuit between the liquid inlet 9 and liquid outlet 10 has an inclined rotation axis which forms, with the longitudinal direction and with the theoretical rolling plane 50, an angle $\alpha$ which is not equal to 90°. This propeller 14 is rotated by means of the electric pumping motor 12 which preferably has a rotating drive shaft 13 which is parallel with the rotation axis of the propeller 14.

According to the invention, the electric pumping motor 12 is arranged below the hydraulic circuit entirely at the outer side of this hydraulic circuit which completely bypasses the pumping motor 12 at the top. The rotating shaft 13 of the pumping motor 12 extends through a lower inclined wall 30 which delimits the hydraulic circuit. The sealing is provided by an O-ring 18.

FIG. 3 is an illustration of the flow of liquid in the hollow body 1 of the device. This flow is illustrated schematically in FIG. 3 by means of the arrows 66. Liquid enters the hollow body 1 via the liquid inlet 9 which is arranged below the device. This liquid passes into the second shell 49 which forms the liquid inlet conduit 15 in order to reach the first shell 55 which forms a debris recovery pocket. This debris recovery pocket allows the liquid to pass through the filtering material and retains the solid debris 60. The filtered liquid reaches the liquid outlet 10 and is discharged at the rear of the device into the pool from which it originates.

Since the liquid outlet 10 is opposite the pumping propeller 14, the liquid flows out of the device via this outlet with a speed V which is orientated along the axis 51 of the pumping propeller 14 and which has a longitudinal component towards the rear which brings about, by means of reaction, forces whose resultant has a longitudinal drive component which is orientated towards the front and which is involved in driving the device over the immersed surface.

The orientation of the hydraulic reaction force produced by the outlet flow and therefore the size of the longitudinal component thereof are dependent on the inclination a relative to the theoretical rolling plane 50, the rotation axis 51 of the propeller and the liquid outlet 10. Preferably, this inclination a is between 15° and 45°.

According to the invention, the electric pumping motor is arranged below the hydraulic circuit entirely at the outer side of this hydraulic circuit so that the filtering device 11 of the hydraulic circuit can be removed from the device via the top of the device as mentioned above, without being impeded by the pumping motor. Only the pumping propeller 14 is arranged in the hydraulic circuit so as to be able to provide the liquid flow. This pumping propeller 14 is arranged at the rear of the device, close to the liquid outlet 10. That is to say, the pumping propeller 14 and the liquid outlet 10 form the end portion of the hydraulic circuit.

In the preferred embodiment of the invention illustrated in the Figures, the rolling members for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and to move the debris which are brushed towards the rear of the device in the direction of the liquid inlet 9 which is arranged below the device.

The device further comprises at least one electric motor 20 for driving the front drive wheels 2. Preferably, the device comprises two drive motors, one at each side, for independently driving each of the front wheels 2, respectively. To this end, each front wheel 2 has an internal toothed arrangement 5 which co-operates with a pinion which is driven by the corresponding drive motor 20.

These brushes 4 may be of any type. According to an embodiment of the invention, the device comprises two front coaxial brushes 4. Each brush 4 is capable of being rotated about an axis which extends in a direction perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by at least one electric motor 20 for driving the front wheels 2 by means of a gear system.

In this manner, in the embodiment illustrated, the rolling members are constituted by the front drive wheels 2, rear non-drive wheels 3 and brushes 4 which are involved in driving and guiding the device over the immersed surface. In any case, the rolling members 2, 3, 4 have zones which are intended to come into contact with the immersed surface and which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, the front wheels 2 make it easier to overcome obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

The electric drive motor and pumping motor may be of any known type. According to a preferred embodiment, these electric motors are low-voltage motors. They may be supplied with electrical power by means of an electrical supply external to the device by means of an electrical cable which is not illustrated in the Figures and which is connected to the device in the region of a zone 19 for introducing the electrical cable into the device, as illustrated in FIG. 1.

Furthermore, according to a preferred embodiment of the invention, the device also comprises an operating handle 7 which allows a user to carry the device in order to immerse it in a liquid and remove it from the liquid. This handle 7 is preferably arranged opposite the liquid outlet 10 so that when the hollow body 1 is suspended via this handle, the device tilts spontaneously under the action of gravity into a position in which the liquid outlet 10 is located below the liquid inlet 9 which allows the device to be emptied. When the device moves from the cleaning position to the emptying position, the debris drawn in by the device are retained in the filtering device and cannot be discharged from the device.

Of course, the invention may involve numerous construction variants and applications.

For example, according to an embodiment which is not illustrated in the Figures, the filtering device 11 comprises a plurality of convergent/divergent liquid inlet conduits 15.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner comprising:

a body; and b. a filtration chamber positioned within the body and removable therefrom, the filtration chamber comprising (i) a filtration pocket and (ii) a water inlet conduit having a first end forming a water inlet into the body and a second end opening into the filtration pocket, the water inlet conduit having a cross-section whose surface area varies from the first end to a maximum value at the second end.

2. A swimming pool cleaner according to claim 1 in which (a) the second end of the water inlet conduit is above the first end thereof when the body is upright and (b) a first cross-section of the water inlet conduit between the first and second ends has surface area less than the surface area of the cross-section at the first end.

3. A swimming pool cleaner according to claim 2 in which a second cross-section of the water inlet conduit between the first and second ends and above the first cross-section has surface area greater than the surface area of the first cross-section.

4. A swimming pool cleaner according to claim 1 in which the water inlet conduit has a cross-section whose surface area varies substantially continuously from the first end to the second end.

5. A swimming pool cleaner according to claim 1 in which the first end of the water inlet conduit forms the only water inlet into the body.

6. A swimming pool cleaner comprising:

a. a body;

b. a filtration pocket; and c. a water inlet conduit (i) formed at least in part by a wall, (ii) having a first end forming a water inlet into the body, (iii) having a second end opening into the filtration pocket, the second end formed at least in part by termination of the wall adjacent the filtration pocket, and (iv) having a cross-section whose surface area varies from the first end to a maximum value at the second end.

7. A swimming pool cleaner according to claim 6 in which (a) the second end of the water inlet conduit is above the first end thereof when the body is upright and (b) a first cross-section of the water inlet conduit between the first and second ends has surface area less than the surface area of the cross-section at the first end.

8. A swimming pool cleaner according to claim 7 in which a second cross-section of the water inlet conduit between the first and second ends and above the first cross-section has surface area greater than the surface area of the first cross-section.

9. A swimming pool cleaner according to claim 6 in which the water inlet conduit has a cross-section whose surface area varies substantially continuously from the first end to the second end.

10. A swimming pool cleaner according to claim 6 in which the first end of the water inlet conduit forms the only water inlet into the body.

* * * * *